US005174741A

United States Patent [19]

Tohgo

[11] Patent Number: 5,174,741

[45] Date of Patent: Dec. 29, 1992

[54] LIQUID INJECTING TYPE OIL-FREE SCREW COMPRESSOR

[75] Inventor: Hideaki Tohgo, Takasago, Japan

[73] Assignee: Kabushiki Kaisha Kobe Seiko Sho, Kobe, Japan

[21] Appl. No.: 842,460

[22] Filed: Feb. 27, 1992

[30] Foreign Application Priority Data

Apr. 12, 1991 [JP] Japan ..... 3-79851

[51] Int. Cl.[5] ..... F01C 21/04

[52] U.S. Cl. ..... 418/84; 418/87; 418/100

[58] Field of Search ..... 418/2, 84, 87, 100

[56] References Cited

U.S. PATENT DOCUMENTS 4,180,986 1/1980 Shaw ..... 418/84
4,289,461 9/1981 van Oorschot et al. ..... 418/84

FOREIGN PATENT DOCUMENTS 0172430 9/1986 European Pat. Off. .
2603666 3/1988 France ..... 418/84
62-265488 11/1987 Japan ..... 418/84
62-271988 11/1987 Japan ..... 418/84
1-216093 8/1989 Japan ..... 418/84
2-275089 11/1990 Japan ..... 418/84
2047808 2/1980 United Kingdom .
8607416 12/1986 World Int. Prop. O. .

*Primary Examiner*—Richard A. Bertsch
*Assistant Examiner*—Alfred Basichas
*Attorney, Agent, or Firm*—Oblon, Spivak, McClelland, Maier & Neustadt

[57] ABSTRACT

A liquid injecting type oil-free screw compressor is capable of preventing the generation of polymer in any part inside the compressor main body. A temperature controller detects the gas temperature in a discharge passage of the compressor main body, and controlling the degree of opening of the flow-rate control vale in such a manner as to control the injected liquid quantity to the inlet port for holding the gas temperature at a saturation temperature. A flow-rate controller controls the degree of opening of the flow-rate control valve to gradually change the flow rate of the liquid quantity from the injected liquid quantity to the liquid quantity at which the concentration of the liquid component at said inlet portion becomes a predetermined value. A selector switch for switches over the control function for controlling the degree of opening of the flow-rate control valve between the temperature controller which is operated in a transient state and the flow-rate controller, which is operated in a normal operating.

2 Claims, 1 Drawing Sheet

LIQUID INJECTING TYPE OIL-FREE SCREW COMPRESSOR

BACKGROUND OF THE INVENTION

1. Field of the Invention

The present invention relates to a liquid injecting type oil-free screw compressor having a liquid injecting passage for injecting the liquid to the inlet port of the compressor main body while controlling the flow rate of the liquid by a flow-rate control valve.

2. Description of the Prior Art

There has been known a liquid injecting type oil-free screw compressor as shown in FIG. 2, wherein there is provided a liquid injecting passage 4 for injecting a liquid to an inlet port 3 of a compressor main body 2 while controlling the flow rate of the liquid by a flow-rate control valve 1. Furthermore, there is provided a temperature controller 6 adapted to detect the gas temperature in a discharge passage 5 of the compressor main body 2 and to control the degree of opening of the flow-rate control valve 1 for controlling the injected liquid quantity to the inlet port 3 for holding the above-mentioned temperature at the gas saturation temperature.

In some gases handled by a compressor such as an off gas or a vent gas for styrene monomer, solid matters such as polymer are generated by the change of conditions caused by compression. The generation of polymer is caused particularly often by the temperature rise by compression. Therefore, in order to control the temperature of a compressed gas to be lower than a temperature at which polymer can be produced, a liquid is injected to the inlet port 3 to keep the temperature of a compressed gas at a specified value by utilizing the latent heat of the liquid. Concretely, the gas temperature in the discharge passage is kept approximately at a gas saturation temperature.

As described in the above, in the conventional device, the injected liquid quantity is specified for holding the gas temperature in a discharge passage 5 approximately at the gas saturation temperature. Inside some parts of the compressor main body 2, however, the gas temperature is considered to be higher than the gas saturation temperature, and thereby it has been impossible to avoid the generation of polymer, a solid matter.

Consequently, the above-mentioned polymer tends to adhere to the screw rotors (not shown) inside the compressor main body, thereby leading to trouble.

SUMMARY OF THE INVENTION

It is therefore an object of the present invention to provide a liquid injecting type oil-free screw compressor capable of preventing the generation of polymer in any part inside the compressor main body.

To achieve the aforesaid object, according to the present invention, there is provided a liquid injecting type oil-free screw compressor having a liquid injecting passage for injecting the liquid to an inlet port of the compressor main body while controlling the flow rate of the liquid by a flow-rate control valve, comprising: a temperature controller for detecting the gas temperature in a discharge passage of the compressor main body, and controlling the degree of opening of the flow-rate control valve in such a manner as to control the injected liquid quantity to the inlet port for holding the gas temperature at a saturation temperature; a flow-rate controller for controlling the degree of opening of the flow-rate control valve to gradually increase the flow rate of the liquid quantity from the injected liquid quantity up to the liquid quantity at which the concentration of the liquid component at the inlet port becomes a predetermined value, or to gradually decrease the liquid quantity from the predetermined value down to the injected liquid quantity; and a selector switch for switching over the control function for controlling the degree of opening of the flow-rate control valve from or to the temperature controller adapted to be operated in a transient state such as the start and stop operation of the compressor main body to or from the flow-rate controller adapted to be operated in a normal operating state excluding the transient state of the compressor main body.

With this construction, the temperature in each part inside the compressor main body is maintained below a temperature at which polymer is generated, and impurities are removed by a part of the liquid exceeding the saturation quantity so that the generation of extraneous matters to stick on the screw rotors is eliminated, whereby mechanically stabilizing the operation of the compressor in a transient state such as the start and stop operation. Furthermore, in a switching period, from a transient state to a normal operating state and vice verse, by gradually increasing or gradually decreasing the quantity of the injecting liquid, that is, by controlling the change rate of the injected liquid quantity, the operation is also stabilized and the sealing function between screw rotors is also upgraded.

DETAILED DESCRIPTION OF THE PREFERRED EMBODIMENTS

Figure 1:
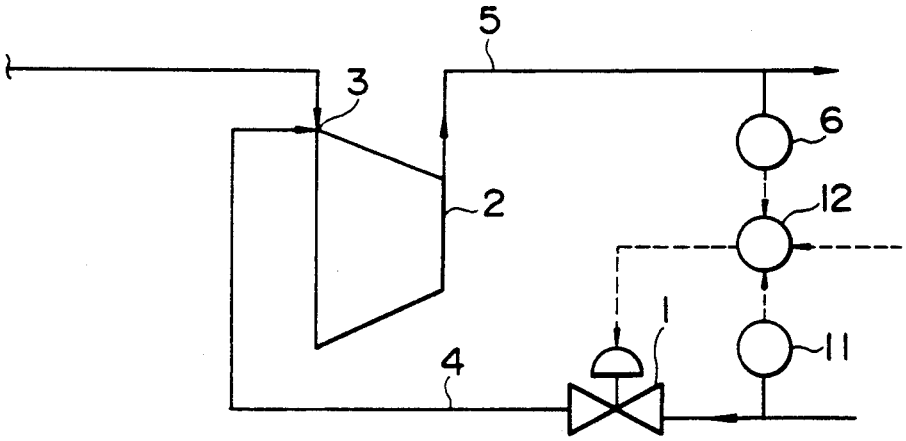
FIG. 1 is a block diagram showing the whole of a liquid feeding type oil-free screw compressor according to the present invention.
Figure 2:
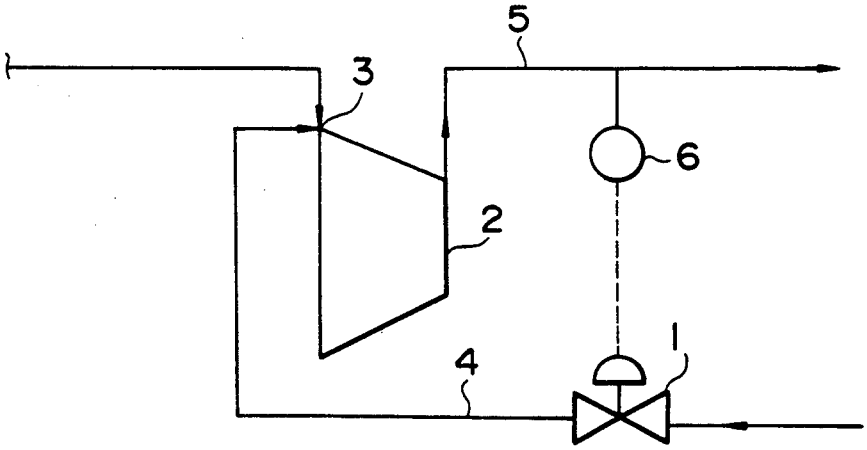
FIG. 2 PRIOR ART
FIG. 2 is a block diagram showing the whole of a conventional liquid feeding type oil-free screw compressor.

FIG. 1 shows a liquid injecting type oil-free screw compressor according to the present invention which is substantially similar to a compressor shown in FIG. 2 except that a flow-rate controller 11 and a selector switch 12 are additionally provided, and the same symbols are given to common parts and the explanation of them is omitted.

The flow-rate controller 11 controls the degree of opening of the flow-rate control valve to gradually increase the flow rate of the liquid from the injected liquid quantity to the inlet 3 for holding the gas temperature inside the discharge passage 5 at a gas saturation temperature up to the liquid quantity at which the concentration of the liquid component at the inlet port 3 becomes the predetermined value, preferably, 300 ppm, or conversely to gradually decrease the flow rate of the liquid from the above-mentioned predetermined value down to the above-mentioned injected liquid quantity. The selector switch 12 switches over the control function for controlling the degree of opening of the flow-rate control valve 1 from or to the temperature controller 6 adapted to be operated in a transient state such as the start and stop operation of the compressor main body 2 to or from the flow-rate controller 11 adapted to be operated in a normal operating state excluding the above-mentioned transient state.

More specifically, in a transient state where suction capacity is small, the flow-rate control valve 1 is controlled by the temperature controller 6 for holding the gas temperature inside the discharge passage to be lower than the gas saturation temperature so as not to yield liquid compression in the compressor main body 2.

On the other hand, when the state of the compressor is shifted to a normal operating state, although the liquid quantity is made a little more than the quantity for holding the gas temperature inside the discharge flow path 5 at a gas saturation temperature, a liquid compression phenomenon does not occur, and the control is switched to the control by the flow-rate controller 11 in which the liquid quantity is controlled to be a little more than the above-mentioned injected liquid quantity.

The switching from the transient state to the normal operating state and vice verse can be detected from the number of revolutions of the rotary portion of the compressor main body 2 or from the change of pressure, etc. of the gas in the discharge passage 5.

In the above period of switching, by gradually increasing or decreasing the injected liquid quantity, that is, by controlling the change rate of the injected liquid quantity, the occurrence of an abnormal vibration of the compressor main body 2 can be prevented and the operation of the compressor is mechanically stabilized.

With this arrangement, the temperature in each part inside the compressor main body is kept below the temperature at which polymer is generated, and extraneous matters to stick on the screw rotors are eliminated by the liquid exceeding the saturation quantity, thereby preventing the device trouble caused by the adhesion of extraneous matters.

In a switching period from a transient state to a normal operating state and vice verse, mechanical stability is secured by gradual increase or gradual decrease of the liquid quantity, that is, by controlling the change rate of the injected liquid quantity, and moreover, there is another effect that the sealing function between the rotors is upgraded.

It is understood that the invention is not to be limited to the exact details of operation or structure shown and described, as obvious modifications and equivalents will be apparent to one skilled in the art.

What is claimed is:

1. An oil-free screw compressor comprising:

a liquid injecting passage for injecting a liquid into an inlet port of a compressor main body;

a flow rate control valve in said liquid injecting passage for controlling the flow rate of the liquid;

a temperature controller for detecting the gas temperature in a discharge passage of the compressor main body, and controlling the degree of opening of the flow-rate control valve as a function of the detected temperature in such a manner as to control the injected liquid quantity to said inlet port for holding said gas temperature at a saturation temperature;

a flow-rate controller for controlling the degree of opening of said flow-rate control valve to gradually change the flow rate of the liquid quantity from said injected liquid quantity to a predetermined value; and a selector switch for switching over the control function for controlling the degree of opening of said flow-rate control valve to said temperature controller in a transient state of said compressor main body and to said flow-rate controller in a normal operating state of said compressor main body.

2. The compressor of claim 1 wherein said predetermined value is substantially 300 ppm.

* * * * *